United States Patent [19]

Milbright et al.

[11] Patent Number: 4,565,038

[45] Date of Patent: Jan. 21, 1986

[54] YOKE FOR USE WITH GUYED STRUCTURES

[75] Inventors: Arnold M. Milbright, Red Wing; Peter A. Hampe, Theilman, both of Minn.

[73] Assignee: International Telephone and Telegraph Corporation, New York, N.Y.

[21] Appl. No.: 471,825

[22] Filed: Mar. 3, 1983

[51] Int. Cl.[4] ..... E04H 12/20; E04B 1/00

[52] U.S. Cl. ..... 52/146; 52/98; 174/43; 248/64

[58] Field of Search ..... 52/143, 40, 146, 147, 52/148, 149, 150, 151, 152, 648, 649, 721, 98, DIG. 11; 174/43, 45 R; 248/64, 58, 514; 211/198

[56] References Cited

U.S. PATENT DOCUMENTS

| | | | |
|---|---|---|---|
| 2,931,606 | 4/1960 | Fraser et al. | 248/64 |
| 3,504,460 | 4/1970 | Solberg | 52/98 |
| 3,638,912 | 2/1972 | Moreno | 52/DIG. 11 |
| 3,684,222 | 8/1972 | Bethea, Jr. | 248/64 |
| 3,967,906 | 7/1976 | Strizki | 52/98 |

FOREIGN PATENT DOCUMENTS

| | | | |
|---|---|---|---|
| 1006033 | 4/1957 | Fed. Rep. of Germany | 174/43 |
| 1283313 | 11/1968 | Fed. Rep. of Germany | 174/45 R |
| 2712979 | 9/1978 | Fed. Rep. of Germany | 174/43 |
| 2719103 | 11/1978 | Fed. Rep. of Germany | 174/43 |
| 2308010 | 11/1976 | France | 248/58 |
| 54-137690 | 10/1979 | Japan | 248/64 |
| 546944 | 3/1977 | U.S.S.R. | 174/43 |
| 571569 | 10/1977 | U.S.S.R. | 52/148 |

*Primary Examiner*—John E. Murtagh
*Assistant Examiner*—Andrew Joseph Rudy
*Attorney, Agent, or Firm*—Donald J. Lenkszus

[57] ABSTRACT

A guy yoke for use in a guyed structure terminate two support guys coupled to said structure and to transfer loads entered on said supported guys to anchor means, said guy yokes includes two arms pivotally coupled to an anchor plate at one end and coupled to guy wires at the other end. A spreader arm is coupled to the arms to maintain them in a fixed position for forces transmitted by the guy lines which are below a predetermined level. The spreader arm is coupled to the two arms by shear bolts or pins. When the forces transmitted to the yoke are at or exceed the predetermined level, one or both of the shear bolts or pins is severed permitting the two arms to swing toward each other and thereby add effective length to the guying.

14 Claims, 6 Drawing Figures

YOKE FOR USE WITH GUYED STRUCTURES

BACKGROUND OF THE INVENTION

This invention pertains to guyed structures, in general, and to a yoke for use in guyed structures such as electrical transmission structures, in particular.

In certain guyed electrical transmission structures, a device called a "yoke" is utilized to terminate two structure guys and transfer their respective loads to a single anchor guy. The two structure guy attachment points are spaced apart a predetermined horizontal distance and the anchor guy is located halfway between them thereby allowing a certain amount of structure rotation due to, for example, differential tension in the conductors and static wires.

Under certain conditions, for example, heavy icing on one side of the structure, or frost heaving, an unbalanced condition may occur where the forces exerted on one or more set of structure guys and their anchor guy may produce sufficient tension to exceed the rated capacity of the guys. Under such conditions, guy failures may occur.

Certain prior yokes are designed to limit the amount of tension load on the guys by changing configuration at a predetermined load in a manner which will introduce additional length in the guy system. By introducing additional length in the guy system the overall loads are reduced. This adding of length to the guy system results in additional deflection of the structure but thereby avoids the collapse of the structure which might otherwise occur if the guy system were to fail.

In such prior yokes, the lengthening of the guy system is obtained by deformation, i.e., bending or buckling, of a yoke member. However, the operation of such devices is subject to considerable operational variation in the initial loading at which the yoke deforms, the final yoke configuration, and the final yoke capacity in its buckled shape.

SUMMARY OF THE INVENTION

In accordance with the principles of the invention, a yoke is provided which is designed to change configuration at a predetermined load in a manner to introduce additional length in a guy system and in which the initial loading at which the change in configuration occurs, the final yoke configuration and the yoke capacity in its changed configuration are predictable and consistent.

A yoke in accordance with the invention, includes two tension plates pivotally coupled together at one end and adapted for connection to an anchor guy and a compression angle coupled to the other end of each tension plate by a shear bolt such that the compression angle spreads the two tension plates apart. The compression angle thus acts as a spreader arm. When the predetermined load limit is reached, one of the two shear bolts is sliced and the two tension plates swing together reducing the guy tension by adding length to the system.

In the illustrative embodiment, the compression plate is an angle plate and further the anchor guy is attached to an anchor plate which is connected to the two tension plates by the pivot connection between the two tension plates.

BRIEF DESCRIPTION OF THE DRAWINGS

The invention may be better understood by a reading of the following detailed description in conjunction with the drawings in which.

DETAILED DESCRIPTION

Figure 2:
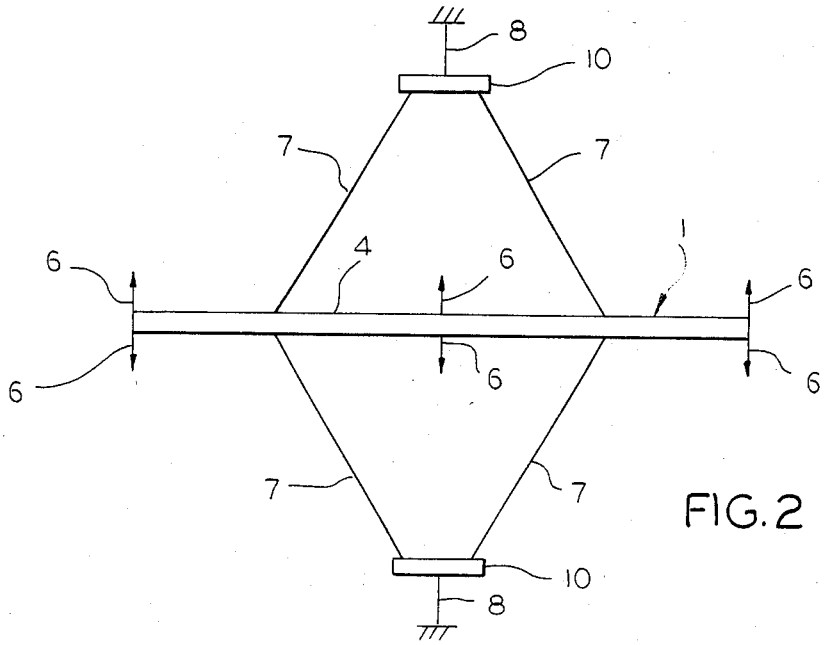
FIG. 2 is a top view of the structure of FIG. 1.
Figure 1:
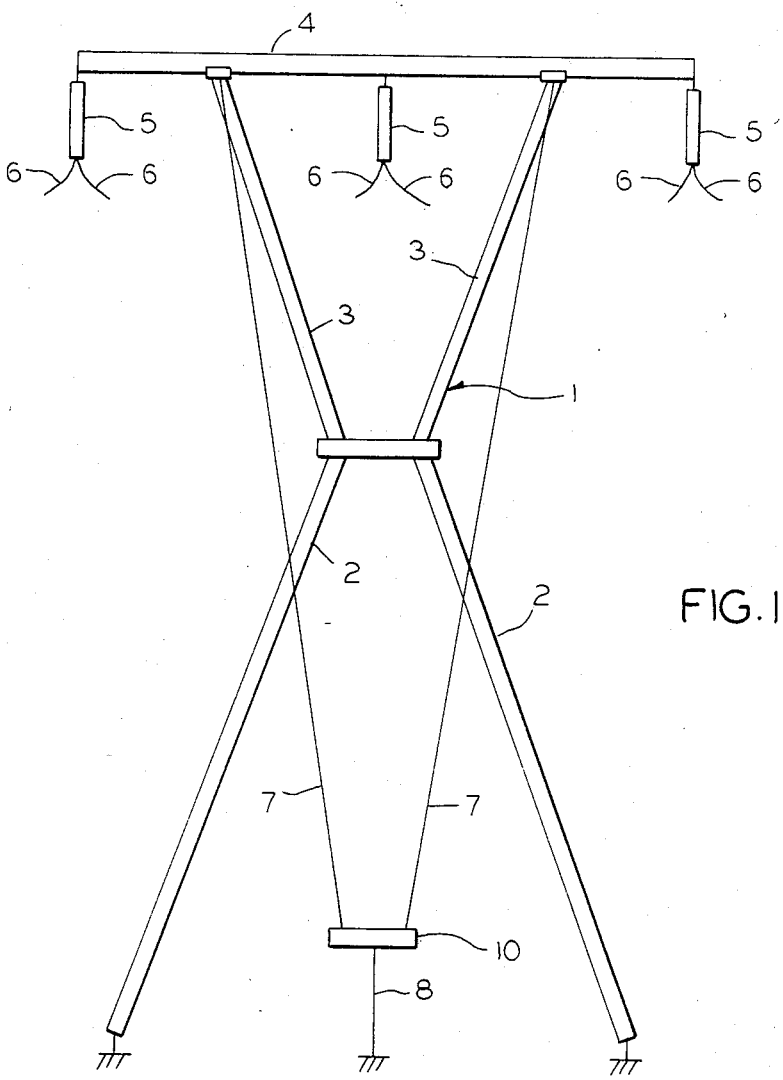
FIG. 1 illustrates an electric transmission structure utilizing a yoke in accordance with the invention.

FIGS. 1 and 2 illustrate an "x" type of electrical transmission structure to which the present invention may advantageously be applied. However, it should be understood that the present invention may be utilized with other types of electrical transmission structures and may be used with guyed structures of other types.

The transmission structure 1 includes bottom legs 2, upper legs 3 and arm 4. Insulators 5 hang from the arm 4 for supporting transmission lines 6. Attached to the arm 4 in the area of juncture with upper legs 3 are support guy cables 7. Two guy cables 7 extend from either side of the arm and are coupled to a guy yoke 10 which is shown symbolically. Each guy yoke is in turn attached to an anchor guy 8 which is firmly anchored to the ground by any conventional method.

Figure 3:
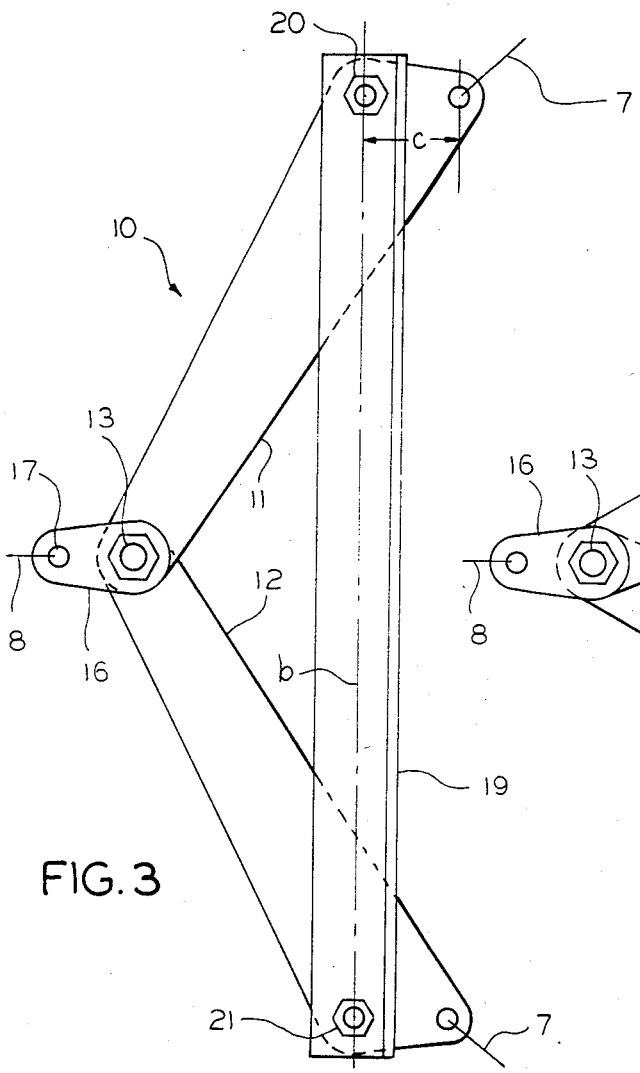
FIG. 3 is a top view of the yoke of FIG. 1.
Figure 4:
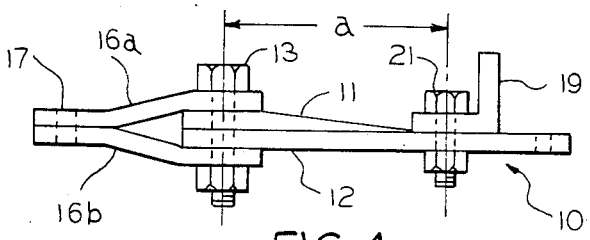
FIG. 4 is a side view of the yoke of FIG. 1.

The yoke 10 as shown in FIGS. 3 and 4 includes plates 11 and 12 which are pivotally coupled together at one end by a hinge bolt 13. Coupled to the plates 11 and 12 by the hinge bolt 13 is an anchor plate 16 which is formed from two identically shaped plates **16*a* and 16*b* which are welded together. The anchor plate 16 includes an aperture 17 which receives a coupling to the anchor guy cable 8. The opposite end of each plate 11 and 12 is coupled to an angle plate 19 by means of a shear bolt 20 and 21, respectively, and each is coupled to a support guy cable 7 by means of connectors which are not shown. Angle plate 19 thus acts as a spreader arm for plates 11 and 12**.

Figure 5:
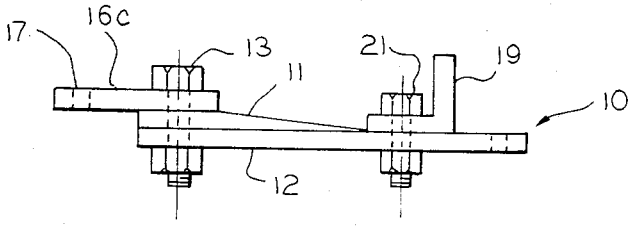
FIG. 5 is a side view of modified yoke.

As will be evident to those skilled in the art, the anchor plate may be formed from a single plate **16*c* such as shown in FIG. 5**.

Figure 6:
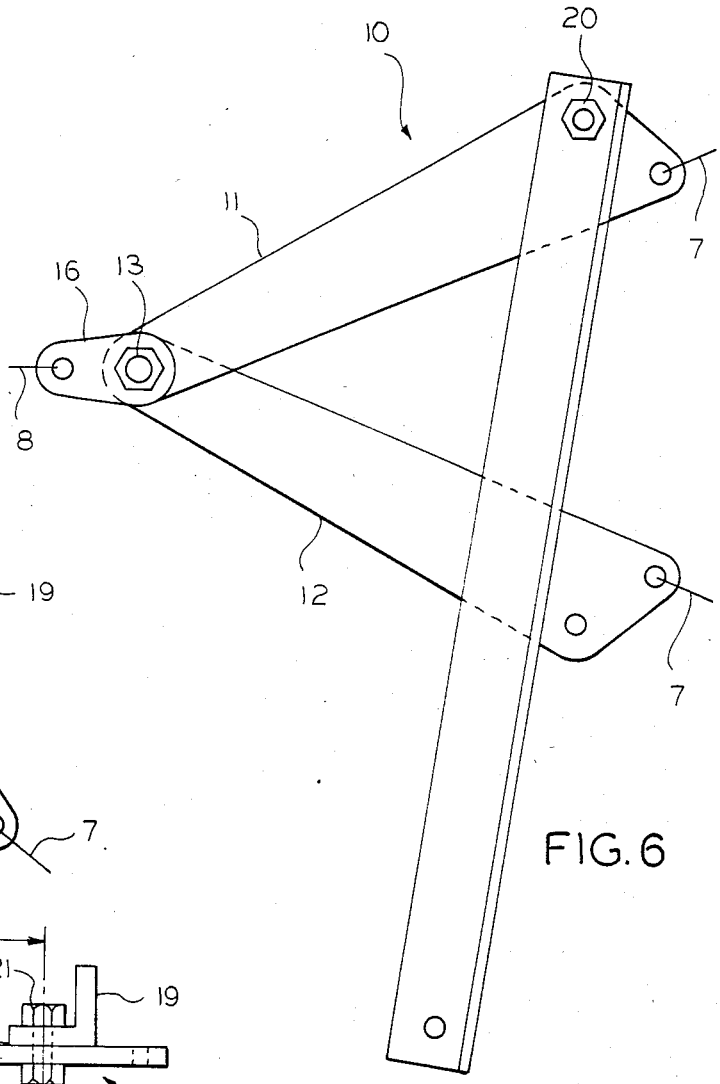
FIG. 6 illustrates the yoke of FIG. 2 when the shear bolt has been severed.

In use, the yoke will maintain its configuration as shown in FIG. 3 for forces on guy cables 7 below a predetermined total value. When the forces exerted on the guy cables exceed the predetermined value, one or the other of shear bolts 20 or 21 will shear thereby eliminating the rigid coupling between the plates 11 and 12 and angle plate 19. The plates 11 and 12 will pivot toward each other to the position shown in FIG. 6 thereby adding length to the guying system.

In an embodiment of the yoke which was subjected to testing, consistent repeatability of the operation of the yoke was measured. For this embodiment, a one-half inch plate having a yield strength of 65,000 pounds per square inch meeting ASTM specification A-588 was utilized for plates 11 and 12 and angle plate 19.

The anchor plates **16*a*, 16*b* were formed of 7/16 inch plate also having a yield strength of 65,000 pounds per square inch. The shear bolts 20 and 21** were one inch diameter SAE Grade 2 having no threads in the shear plane and the hinge bolt selected was a 1½ inch diameter bolt having a yield strength of 110,000 pounds per square inch meeting ASTM specification A-354-BC.

The angle plate was formed as a 4 inch by 4 inch angle. By using an angle plate, the plate is less likely to deform.

The yoke had the following operative dimensions with reference to FIG. 3: a=48 inches; b=12 inches; and c=4 inches.

Over several tests, it was found that one of the shear bolts would be sliced when the total force on the support guys was 37,000 pounds±5 percent, i.e. when the force on each support guy exceeded 18,500 pounds, then one shear bolt would shear off.

If should be noted that the terms "pin" and "bolt" are used interchangeably herein.

What is claimed is:

1. A guy yoke for use in a guyed structure to terminate two support guys coupled to said structure and to transfer loads exerted on said support guys to anchor means, said guy yoke comprising:

a first arm;

a second arm;

first means for pivotally coupling one end of said first arm to one end of said second arm, said first means being coupleable to said anchor means;

a spreader arm;

a first shear pin coupling one end of said spreader arm to the other end of said first arm;

a second shear pin coupling the other end of said spreader arm to the other end of said first arm;

second means adapted for coupling said other end of said first arm to a first support guy;

third means adapted for coupling said other end of said second arm to a second support guy;

said spreader arm maintaining said first and second arms in a first predetermined relative position when forces exerted on said yoke by said first and second support guys are below a predetermined force;

at least one of said shear pins being sheared when said forces exceed said predetermined force whereby said spreader arm no longer maintains said first and second arms in said first relative position and said first and second arms assume a second position relative to each other.

2. A guy yoke in accordance with claim 1, wherein said spreader arm is an angle plate.

3. A guy yoke in accordance with claim 1, wherein said first means comprises a first aperture through said first arm, second aperture through said second arm and a bolt extending through said aperture.

4. A guy yoke in accordance with claim 3, wherein said first means further comprises an anchor plate adapted to receive said bolt, said anchor plate being coupleable to said anchor means.

5. A guy yoke in accordance with claim 4, wherein said anchor plate comprises two plates coupled together at one end and spread apart at the other end and adapted at said other end to straddle said first and second arms and to receive said bolt.

6. A guy yoke in accordance with claim 1, wherein said second means comprises an aperture in said first arm and said third means comprises an aperture in said second arm.

7. A guy yoke for use in a guyed structure to terminate two support guys coupled to said structure and to transfer loads exerted on said supported guys to anchor means, and guy yoke comprising:

an anchor plate coupleable to said anchor means;

a first arm pivotally connected to said anchor plate and adapted to be connected to a first support guy;

a second arm pivotally connected to said anchor plate and adapted to be connected to a second support arm;

a spreader arm having one end coupled to said first arm and having its other end coupled to said second arm with a shear pin.

8. A guy yoke in accordance with claim 7, wherein said anchor plate comprises two plates fastened together at one end and adapted at said one end to be coupled to an anchor guy and spread apart at the other end to straddle said first and second arms and wherein said first arm, said second arm and other ends of said two plates are pivotally connected by a bolt.

9. A guy yoke in accordance with claim 8, wherein said spreader arm is an angle plate.

10. A guyed transmission structure comprising:

a guyed tower for supporting transmission lines;

first and second guy lines extending from said tower;

a yoke coupled to said first and second guy lines and to an anchor means;

said yoke comprising:

first and second arms pivotally coupled together and to said anchor means and a spreader arm connected to said first arm and connected to said second arm by a shear pin, said spreader arm maintaining said first arm in a predetermined position relative to said second arm for forces below a predetermined level transmitted to said yoke by said first and second guy lines.

11. A structure in accordance with claim 10, wherein when said forces exceed said predetermined level, said second arm and said spreader arm shear said shear pin whereby said first and second arms become free to pivotally more from said predetermined position.

12. A structure in accordance with claim 11, wherein said spreader arm is an angle plate.

13. A guy yoke for use in a guyed structure to terminate two support guys coupled to said structure and to transfer the loads exerted on said support guys to anchor means, said guy yoke comprising:

a first arm adapted to be coupled to a first guy;

a second arm adapted to be coupled to a second guy;

means for pivotally coupling said first arm and said second arm to a common connection, said common connection being coupled to said anchor means;

a spreader arm coupled to said first arm by a first shear pin and coupled to said second arm by a second shear pin;

said spreader arm and said first and second shear pins maintaining said first arm in a fixed position relative to said second arm for forces below a predetermined level transmitted by said first and second guys to said yoke;

said spreader arm and said first and second arms cooperatively exerting shearing forces on at least one of said first or second shear pins when said forces are at or exceed said predetermined level whereby said at least one shear pin is sheared permitting said first arm to pivot relative to said second arm.

14. A guy yoke in accordance with claim 13, wherein said spreader arm is an angle plate.

* * * * *